United States Patent [19]

Weber et al.

[11] Patent Number: 4,786,469

[45] **Date of Patent: * Nov. 22, 1988**

[54] GRAIN REFINING METALS

[75] Inventors: Gerhard Weber; Winfried Reif, both of Berlin, Fed. Rep. of Germany

[73] Assignee: London & Scandinavian Metallurgical Co Limited, London, England

[ * ] Notice: The portion of the term of this patent subsequent to Nov. 22, 2004 has been disclaimed.

[21] Appl. No.: 895,502

[22] Filed: Aug. 11, 1986

[30] Foreign Application Priority Data

Aug. 23, 1985 [GB] United Kingdom ..... 8521134

[51] Int. Cl.[4] ..... C22B 15/14; C22C 9/00

[52] U.S. Cl. ..... 420/469; 420/492; 420/576; 75/76; 148/432

[58] Field of Search ..... 420/469, 492, 499, 500, 420/576, 579; 148/432–436; 75/76

[56] References Cited

U.S. PATENT DOCUMENTS 4,559,200 12/1985 Yamasaki et al. ..... 420/492

4,708,739 11/1987 Kellie et al. ..... 420/469

*Primary Examiner*—L. Dewayne Rutledge

*Assistant Examiner*—George Wyszomierski

*Attorney, Agent, or Firm*—L. S. Van Landingham, Jr.

[57] ABSTRACT

The invention provides a grain refinement method for copper-based metals, which method can be applied to a range of different types of such metals. In accordance with the method, one arranges that a melt of the metal to be grain refined contains each of the following components:

(a) titanium and/or zirconium;

(b) at least one of: lithium, sodium, potassium, beryllium, magnesium, calcium, strontium and barium;

(c) at least one of: scandium, yttrium, titanium, zirconium, hafnium, vanadium, niobium, tantalum, chromium, molybdenum, tungsten, manganese, technetium, rhenium, iron, ruthenium, osmium, cobalt, rhodium, iridium, nickel, palladium, platinum, silver, gold, zinc, cadmium, mercury and the rare earth elements; and (d) at least one of: aluminium, gallium, indium, silicon, germanium, tin, lead, phosphorus, arsenic, antimony, bismuth, sulphur, selenium and tellurium;

and solidifies the melt to produce grain refinement of the copper-based metal. The invention also provides grain refiners for practicing the method.

30 Claims, 5 Drawing Sheets

GRAIN REFINING METALS

This invention relates to grain refining metals, and is more especially concerned with grain refining copper-based metals.

It is well known that grain refinement of metals can produce the following advantages:

1. better flow properties;
2. lower tendency to hot cracking;
3. better surface quality of castings;
4. better feeding and consolidation, due to increased volume contraction;
5. improvement in the mechanical, physical and electrochemical properties;
6. reduction in the need for thermomechanical post-treatment (working and annealing).

A great deal of work has been carried out of the grain refinement of aluminium-based metals, both aluminium itself and aluminium alloys. Grain refinement of aluminium-based metals is used in normal commercial practice, and is usually achieved by adding a suitable grain refiner, such as an aluminium-titanium-boron or aluminium-titanium master alloy, to a melt of the aluminium-based metal which is to be grain refined, and casting the thus-treated metal. There is now a considerable degree of understanding of the basic mechanism by which this grain refinement occurs, although it has to be said that there is still much controversy over the more detailed aspects of this mechanism. It is generally true to say that a grain refiner which is effective with one aluminium-based metal will be effective with aluminium-based metals generally, although it has been found that some aluminium alloys contain constituents which will poison certain grain refiners which are fully effective with other aluminium-based metals.

Copper-based metals, like aluminium-based metals, are widely used in industry and daily life, and the world rate of consumption of copper is currently nearly two thirds that of aluminium. It has long been appreciated that it would be desirable to be able to bring about the grain refinement of copper-based metals by the use of grain refiners. However, in spite of this, and of the enormous usage of copper-based metals, as far as we are aware, there has been little, if any, successful use of grain refiners in copper-based metals.

Over the years, there have been publications relating to various grain refiners for various copper-based metals. For example, the following references disclose the use of zirconium, iron, boron and/or phosphorus for the grain refinement of copper-tin bronze:

1. A. Cibula, Journal of the Institute of Metals, volume 82 (1953/54), p. 513 et seq.
2. A. Couture and J. O. Edwards, Giesserei-Praxis, (1974), No. 21, p. 425 et seq. (in German); and AFS Cast Metals Research Journal, volume 10, (1974) No. 1 p.p. 1–5 (in English).
3. J. Breme, Zeitschrift fuer Metallkunde, volume 72 (1981), No. 10, p. 661 et a seq.

However, such copper grain refiners as are disclosed in the literature are of limited application as regards the range of copper-based metals with which they will work, and none of these grain refiners has, we believe, met with any commercial success. Furthermore, there are many types of copper-based metals for which no grain refiner has so far been found. For example, so far as we are aware, prior to the present invention, there was no known grain refiner for copper-based bearing alloys.

According to the present invention, there is provided a method of grain refining a copper-based metal, the method comprising arranging that a melt of the metal to be grain refined contains each of the following components:

(a) titanium and/or zirconium;

(b) at least one of: lithium, sodium, potassium, beryllium, magnesium, calcium, strontium and barium;

(c) at least one of: scandium, yttrium, titanium, zirconium, hafnium, vanadium, niobium, tantalum, chromium, molybdenum, tungsten, manganese, technetium, rhenium, iron, ruthenium, osmium, cobalt, rhodium, iridium, nickel, palladium, platinum, silver, gold, zinc, cadmium, mercury and the rare earth elements; and (d) at least one of: aluminium, gallium, indium, silicon, germanium, tin, lead, phosphorus, arsenic, antimony, bismuth, sulphur, selenium and tellirium; and solidifying the melt to produce grain refinement of the copper-based metal.

Neither we nor the present inventors have so far been able to elucidate the precise mechanism by which the grain refinement brought about by the method of the invention occurs, but we do know that it involves the provision of some kind of nucleant particles for the copper-based metal melt as it solidifies.

The lists given above for components (a), (b), (c) and (d) have been drawn up as a result of a large number of tests carried out by the inventors. All of the elements listed have been tested, with the exception of scandium, yttrium, technetium, rhodium, hafnium, rhenium, osmium, mercury and the rare earth elements other than cerium in the list for component (c). Nevertheless, we believe that the latter untested elements are also fully effective as component (c) materials.

In all of the tests, the materials specified for components (a) to (d) were added as either the respective elements or as master alloys.

It will be seen that titanium and zirconium are both included both in the list for component (a) and in the list for component (c), and, for the avoidance of doubt, it is pointed out that it is not sufficient to select just one of titanium and zirconium to serve as both component (a) and component (c); however, where one of titanium and zirconium is selected as component (a), the other may be selected as component (c).

Preferably, component (a) includes zirconium, as it has been found to be more effective than titanium.

Component (b) preferably comprises at least one of: magnesium, calcium, strontium and barium, and most preferably comprises magnesium.

All of the elements tested in the list of component (c) materials have been found to be similar in their effectiveness. Iron is preferred from the point of view of cost, although in some cases it may be preferable to use one or more of the other possibilities, where the presence of iron in the grain refined metal would not be acceptable. Silver and tungsten have both been found to give slightly better results as component (c) than iron, but of course they are both more expensive than iron.

From the point of view of performance and cost, we prefer that component (d) should be one comprising phosphorus. However, we have found that, if component (d) comprises antimony and at least one of selenium and tellurium, grain refinement as good as that obtainable using phosphorus can be obtained. Component (d) can then be added as an antimony-based master alloy containing selenium, or as an antimony-based master alloy containing tellurium.

In accordance with a preferred embodiment of the invention, component (a) comprises zirconium; component (b) comprises at least one of: magnesium, calcium, strontium and barium; component (c) comprises iron; and component (d) comprises phosphorus.

It has been found that especially good results can be obtained if the melt of the metal to grain refined, containing components (a) to (d), also contains at least a trace of carbon. This can conveniently be achieved by arranging that the said melt is contained in a vessel comprising a surface comprising graphite or other carbonaceous material, which surface is in contact with the melt. Of course, the carbonaceous material need not be present only at the respective surface; for example, the vessel may be made entirely of the carbonaceous material Thus, it may, for example, by a silicon carbide type of crucible.

As a result of the tests which have been carried out, we believe that the optimum quantities of components (a) to (d) in the melt of the metal which is to be grain refined lie within the following ranges:

| Component | Amount, in mass % |
|---|---|
| (a) | 0.01 to 0.1 |
| (b) | 0.01 to 0.1 |
| (c) | 0.003 to 0.1 |
| (d) | 0.003 to 0.02 |

Conveniently, one or more of components (a) to (d) is added as a master alloy. It is preferable for the master alloy(s) used to be copper-based, where possible, although it (or they) may instead be based on another metal, such as aluminium for example, where the presence of the other metal in the grain refined alloy is acceptable. In cases where the final, grain refined alloy is required to contain one or more additional constituents, at least one of components (a) to (d) may be added by means of an master alloy which is based on, or at least contains, one or more such other constituent.

It will often be found convenient to add each of components (a) to (d) by means of a different master alloy: in this way, the individual contents of each of components (a) to (d) in the melt may be controlled individually. In a preferred embodiment of the invention using this arrangement, component (a) is added as a copper-based alloy comprising zirconium; component (b) is added as one or more copper-based alloys comprising one or more of magnesium, calcium, strontium and barium, component (c)is added as a copper-based alloy comprising iron, and component (d) is added as a copper-based alloy comprising phosphorus.

In many circumstances, it will be convenient to add components (a) to (d) as a single master alloy. In a preferred embodiment of the invention using this arrangement, components (a) to (d) are added as a copper-based master alloy comprising: (a) zirconium; (b) at least one of: magnesium, calcium, strontium and barium; (c) iron; and (d) phosphorus.

Copper-based metals which have been successfully grain refined by the method of the invention are:

1. Alpha-Beta-Brasses and Alpha-Brasses.

The brasses are copper-based alloys which contain zinc. Apart from the incidental impurities, they may also contain small proportions of one or more additional alloying components. Alpha-beta-brasses are brasses whose zinc content (between about 30 and 40 mass %) is such that both alpha and beta phases are present. By the same token, alpha brasses consist entirely of the alpha phase, and have a zinc content of up to about 30 mass %.

2. Bronzes.

The bronzes are copper-based alloys which contain tin. The following bronzes, in particular, have been successfully grain refined by the method of the invention:

2A. Tin Bronzes.

These are copper-based alloys which substantially consist of copper, tin and incidental impurities.

2B. Leaded Bronzes.

These are bronzes which are used for bearings, and generally comprise, in mass %, 5–10 tin, 5–30 lead, balance copper and incidental impurities.

3. Gunmetals.

These are copper-based alloys containing tin (generally 5 to 10 mass %) and zinc (generally 2 to 5 mass %). In addition to the incidental impurities, other elements, such as lead and/or nickel, for example, may be present.

The present invention also comprehends a grain refiner for grain refining a copper-based metal, as defined in the appended claims relating to grain refiners.

In order that the invention may be more fully understood, some embodiments in accordance therewith will now be described, in the following Examples, with reference to the accompanying drawings, wherein.

Figure 6:
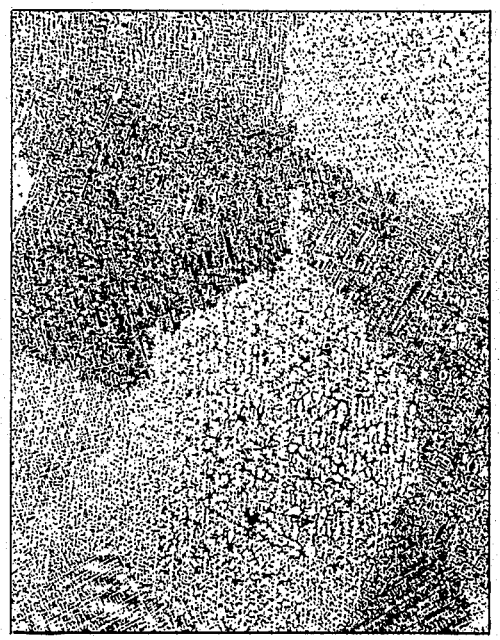
Figure 7:
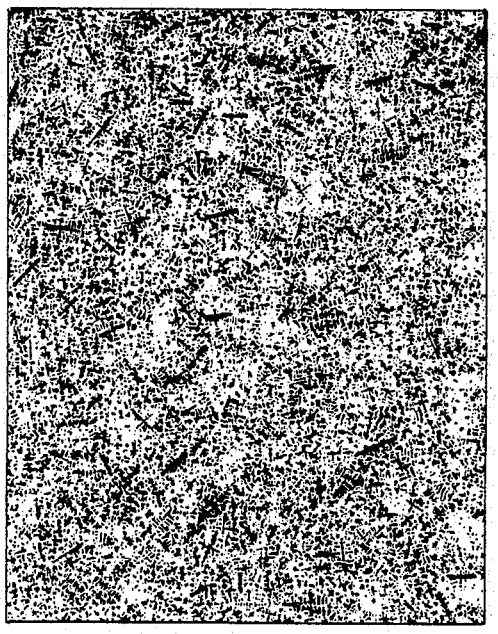
Figure 8:
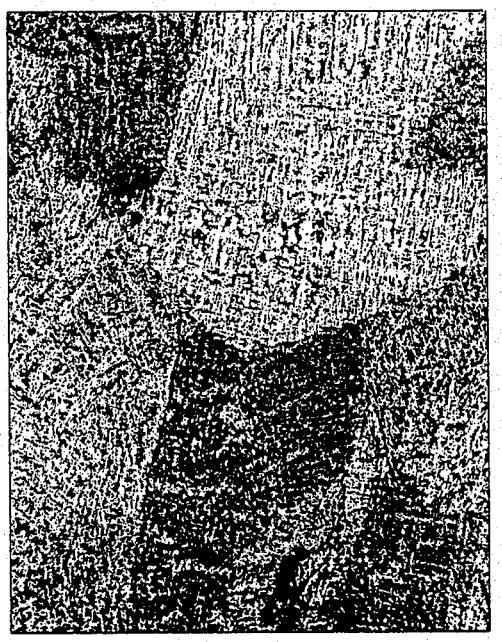
Figure 9:
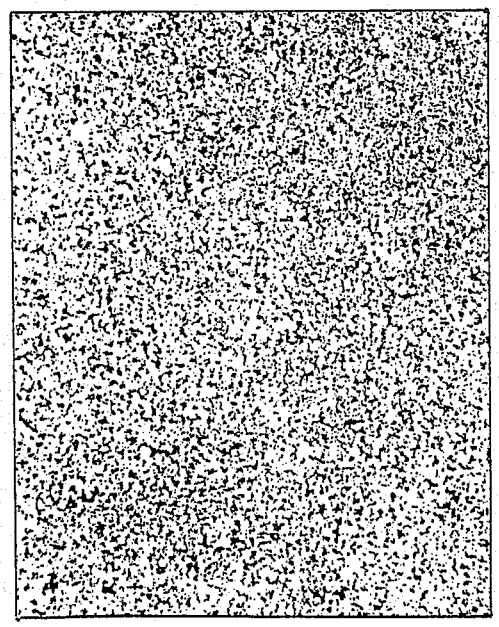

FIGS. 6 and 7 show optical micrographs, both at a magnification of 50:1, of a gunmetal alloy, CuSn-5An5Pb5, respectively un-grain refined, and grain refined in accordance with the method of the invention; and FIGS. 8 and 9 show optical micrographs, both at a magnification of 50:1, of a leaded bronze bearing alloy, CuPb22Sn3, respectively un-grain refined, and grain refined in accordance with the invention.

In each of the following Examples 1 to 4, a range of alloy compositions of a given type (respectively alpha-beta-brasses, tin bronzes, gunmetals and leaded bronze bearing alloys) was subjected to grain refinement tests, using various master alloys. Table 1 describes the alloys subjected to the grain refinement tests in the respective Examples, and Table 2 describes the master alloys used, as well as the method by which they had been obtained.

TABLE 1

Alloys Tested

| No. | Alloy | Purity | Impurities | Production and Materials | Melting Furnace and Atmosphere |
|---|---|---|---|---|---|
| 1 | Alpha-Beta Brass 32–40 m % Zn | Synthetic | 0.006 m % Fe<br>0.002 m % Se<br><0.001 m % P | Bought | Vacuum induction Argon at 760 torr |
| 2 | CuSn Alloy 4–20 m % Sn | Synthetic | <0.01 m % Mn, Si, Ni, Al<br>0.005 m % Fe, Pb<br>0.03 m % Zn<br>0.04 m % P | Bought or produced from pure metals | Resistance Air |
| 3 | Gun metal +Rg5–Rg10 | Synthetic | | Produced from pure metals<br>*CuSn<br>Pb 99.999<br>Zn 99.999 | Resistance Air |
| 4 | Bearing metal CuPb22Sn3 | Synthetic | | Produced from pure metals<br>Cu 99.997<br>Pb 99.99<br>Sn 99.99 | Resistance Air |

+Examples of the compositions of the alloys tested (in mass %) are:
Rg5: Sn = 5, Zn = 5, Pb = 5, balance Cu and impurities.
Rg7: Sn = 7, Zn = 4, Pb = 6, balance Cu and impurities.
Rg10: Sn = 10, Zn = 4, Pb = 1.5, balance Cu and impurities.
*Impurities: as for Alloy No. 2.

TABLE 2

Master Alloy Production.

| No. | Composition | Materials Used | Production |
|---|---|---|---|
| A | CuZr7.5 | 99.997 Cu<br>99.99 Zr | in the electron beam furnace, under argon |
| B | CuMg10 | 99.997 Cu<br>99.99 Mg | in the vacuum induction furnace, under argon |
| C | CuFe7 | 99.997 Cu<br>99.95 Fe | in the vacuum induction furnace, under argon |
| D | CuP7 | not known | normal commercial production |
| E | CuCa10 | 99.997 Cu<br>99.9 Ca | in the vacuum induction furnace, under argon |
| F | CuSr10 | 99.997 Cu<br>99.9 Sr | in the vacuum induction furnace, under argon |
| G | CuBa6 | 99.997 Cu<br>BaCl3 | in the vacuum induction furnace, under argon |
| G1 | CuBe2 | not known | normal commercial production |
| H | CuZr8Mg4Fe2P2 | 99.997 Cu<br>99.99 Mg<br>99.95 Fe<br>CuP7 | in the resistance furnace, in air |

In each of the grain refinement tests in the Examples, 220 g of the respective alloy was melted in a pure graphite crucible. Melting of the brass alloys was carried out under an argon atmosphere at 760 torr in a vacuum induction furnace. The remaining alloys were melted in air, without any slag cover, in a resistance furnace. In all of the tests, the melt temperature lay between 1100 degrees C. and 1200 degrees C., depending on the particular alloy. The grain refining additions were added to the melt wrapped in copper foil. In order to attain uniform distribution of the grain refining addition, the melt was stirred with a graphite rod. This was not necessary in the case of inductive melting. After holding for between 5 minutes and 15 hours, the melt was cast in a zirconium silicate dressed iron mould (30 mm in diameter and 60 mm high). The mould temperature was varied between room temperature and 500 degrees C.

For the metallographic tests, the samples were cut transversely 15 mm from the base, polished, and etched in alcoholic ferric chloride

EXAMPLE 1

Alpha-Beta-Cu-Zn Alloys

In this series of tests, the alloys were melted at 1070–1100 degrees C. Unless otherwise specified, the holding time was 5 minutes, and the mould temperature was 150 degrees C.

Here, grain refinement was brought about by addition of binary alloys (Table 2), as follows:

1. 0.4–0.6 mass % master alloy A.
2. 0.1–1.0 mass % master alloy B.
3. 0.05–0.2 mass % master alloy C.
4. 0.05–0.2 mass % master alloy D.

The structure of the alloys without any addition has a coarse columnar cystalline morphology, the columnar crystalline volume proportion in the structure being about 75%.

Figure 1:
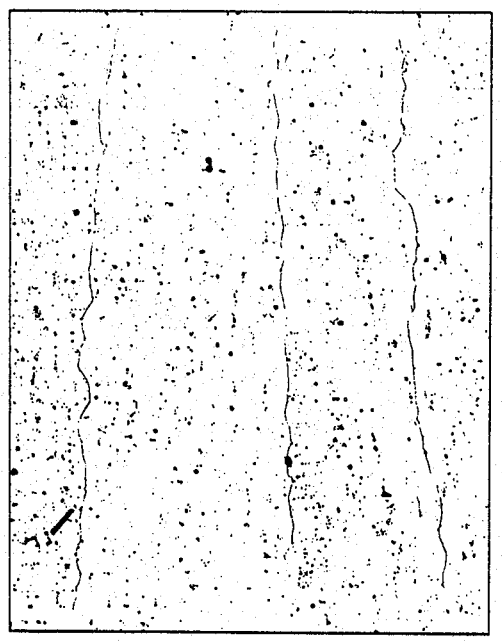
FIGS. 1 and 2 show optical micrographs, both at a magnification of 100:1, of a alpha-beta-brass alloy, CuZn36, respectively un-grain refined, and grain refined in accordance with the invention.

Microscopic studies showed that the structure consisted of an alpha- primary phase, with beta- precipitates on the grain boundaries (FIG. 1).

Figure 2:
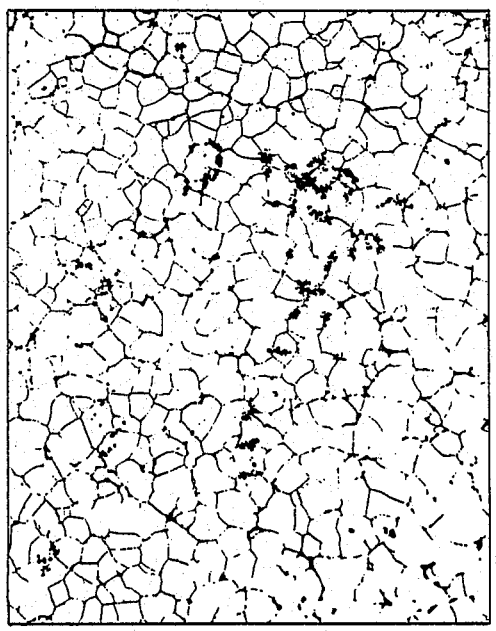

Grain refinement causes the structure to change to a fine, equiaxed morphology. A uniformly homogeneous structure was observed throughout the entire section, as can be seen in FIG. 2. Random tests have shown that addition of multi-element master alloy H (Table 2) can equally give a pronounced grain refined structure (similar to FIG. 2) with these alloys.

Scanning electron microscope studies of the alloys, grain refined with binary or multi-element master alloys, show that the grain refinement is due to nucleation of the primary phase by species introduced into the alloys which act as nucleation centres.

Variation of the holding time from 15 minutes to 15 hours, and of the mould temperature from room temperature to 500 degrees C., had no significant effect on grain refinement.

Binary master alloy B can be substituted by master alloy E, F, G, or Gl without any influence on the grain refinement.

EXAMPLE 2

Cu-Sn Alloys

In this series of tests carried out in the resistance furnace, as well as with the following alloys (Examples 3 and 4), melting was at 1200 degrees C., and the holding time was 5 minutes. The mould was not pre-heated in this case.

Figure 3:
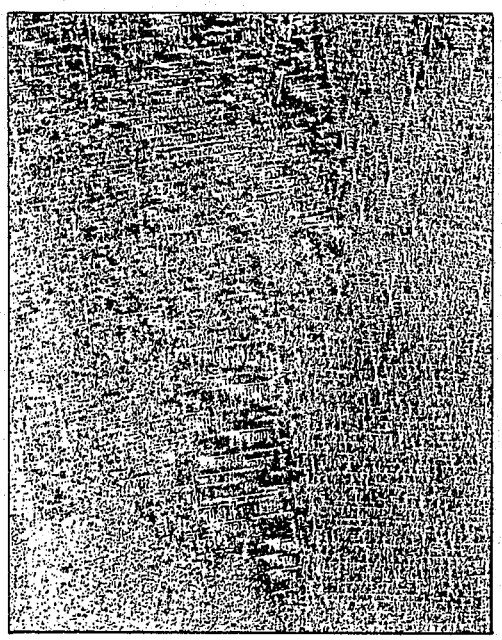
FIGS. 3 and 4 show optical micrographs, both at a magnification of 50:1, of a first tin bronze alloy, CuSn10, respectively un-grain refined, and grain refined in accordance with the invention.
Figure 4:
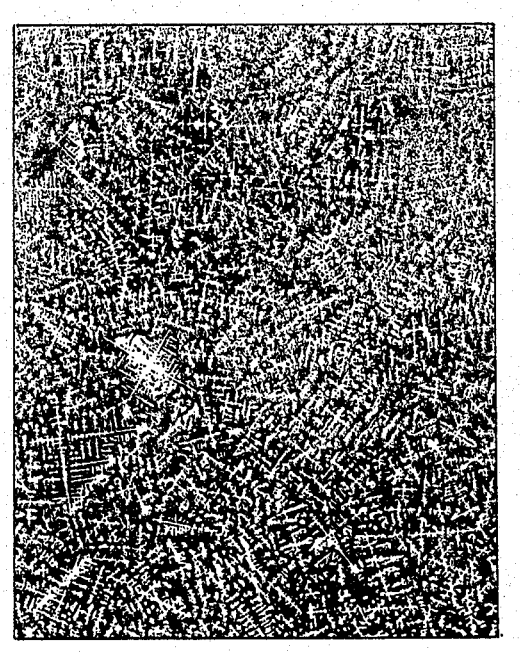
Figure 5:
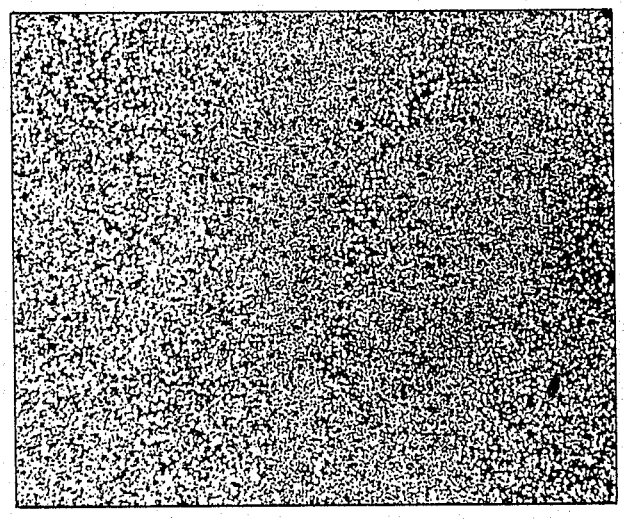
FIG. 5 shows an optical micrograph, at a magnification of 50:1, of a second tin bronze alloy, CuSn20, grain refined in accordance with the invention.

Grain refinement was produced in a manner analogous to that in Example 1. FIG. 3 shows the cast structure of the commercial alloy SAE 63, CuSn10 (representative of other CuSn alloys). The structure has a coarse dendritic form. On grain refinement (FIG. 4), the grain size in the structure decreases, the alpha- dendrites becoming smaller and somewhat coarser. It became apparent that the grain refining effect improved with increasing Sn content. FIG. 5 shows this with the alloy Cu-Sn20. Grain refinement of this alloy gave a fine equiaxed structure.

The scanning electron microscope test results are comparable with those described in Example 1. Limited research into the influence of the casting parameters of the grain refinement effect with these alloys as well as those which are the subject of Examples 3 and 4, has shown that casting parameters do not have any major effect on any of these types of alloys.

EXAMPLE 3

Gun Metal Alloys

Grain refinement is produced in a manner analogous to that in Example 2. FIG. 6 shows the cast structure of the synthetic alloy CuSn5ZnPb5 (representative of other gun metal alloys) without a grain refining addition. The structure has a coarse-grained dendritic form. After grain refinement (FIG. 7), the grain sizes are reduced, and the dendrites finely formed. The scanning electron microscope test results are comparable with those described in Example 1.

EXAMPLE 4

Leaded Bronze Bearing Metals

Grain refinement is produced in a manner analogous to that in Example 2. FIG. 8 shows the cast structure of the synthetic alloy CuPb22Sn3 (representative of other copper-based bearing metals) without a grain refining addition. The structure has a coarse-grained form, with copper primary dendrites. There are lead and tin precipitates at the grain boundaries.

The grain size is substantially reduced by the grain refinement (FIG. 9), the copper dendrites being replaced by very fine "rosettes".

The scanning electron microscope test results are likewise comparable with those described in Example 1.

When tin is not present in these alloys, grain refinement is similarly produced, by not so successfully, however, as in FIG. 9.

This structure clearly shows the desired regular lead precipitate distribution.

We claim:

1. A method of grain refining a copper-based metal, the method comprising preparing a melt of a grain refinable copper-based metal to be grain refined which is deficient in at least one of the following components (a) to (d), said components (a) to (d) consisting essentially of:

(a) zirconium;

(b) at least one substance selected from the group consisting of lithium, sodium, potassium, beryllium, magnesium, calcium, strontium and barium;

(c) at least one substance selected from the group consisting of scandium yttrium, hafnium, vanadium, niobium, tantalum, chromium, molybdenum, tungsten, manganese, technetium, rhenium, iron, ruthenium, osmium, cobalt, rhodium, iridium, nickel, palladium, platinum, silver, gold, zinc, cadmium, mercury and the rare earth elements; and (d) at least one substance selected from the group consisting of aluminium, gallium, indium, silicon, germanium, tin, lead, phosphorus, arsenic, antimony, bismuth, sulphur, selenium, and tellurium;

introducing said deficient component of components (a) to (d) into said melt of grain-refinable copper-based metal by means of at least one grain-refining additive which consists essentially of at least one of said components (a) to (d) including said deficient component or components, and thereafter solidifying said melt of grain-refinable copper-based metal which now contains each of said components (a) to (d) to produce grain refined copper-based metal.

2. A method according to claim 1, wherein component (a) is zirconium, component (b) is magnesium, component (c) is iron, and component (d) is phosphorus.

3. A method according to claim 1, wherein component (b) comprises at least one of: magnesium, calcium, strontium and barium.

4. A method according to claim 3, wherein component (b) comprises magnesium.

5. A method according to claim 1, wherein component (c) comprises at least one of: iron, silver and tungsten.

6. A method according to claim 5, wherein component (c) comprises iron.

7. A method according to claim 1, wherein component (d) is added as an antimony-based master alloy containing at least one substance selected from the group consisting of selecium, tellurium and mixtures thereof.

8. A method according to claim 1, wherein component (d) comprises phosphorus.

9. A method according to claim 1, wherein component (a) comprises zirconium; component (b) comprises at least one of: magnesium, calcium, strontium and barium; component (c) comprises iron; and component (d) comprises phosphorus.

10. A method according to claim 1, wherein the melt of the metal to be grain refined, containing components (a) to (d), also contains at least a trace of carbon.

11. A method according to claim 1 wherein the amount of component (a) contained in the melt of the metal which is to be grain refined is 0.01 to 0.1 mass %; the amount of component (b) contained in the melt of the metal which is to be grain refined is 0.01 to 0.1 mass %: the amount of component (c) contained in the melt of the metal which is to be grain refined is 0.003 to 0.1 mass %; and the amount of component (d) contained in the melt of the metal which is to be grain refined in 0.003 to 0.02 mass %.

12. A method according to claim 1, wherein at least one of the components (a) to (d) is added as a master alloy selected from the group consisting of aluminium-based master alloys and copperbased master alloys.

13. A method according to claim 12, wherein component (a) is added as a copper-based alloy comprising, zirconium; component (b) is added as one or more copper-based alloys comprising one or more of magnesium, calcium, strontium and barium, component (c) is added as a copper-based alloy comprising iron, and component (d) is added as a copper-based alloy comprising phosphorus.

14. A method according to claim 12, wherein components (a) to (d) are added as a copper-based master alloy comprising: (a) zirconium; (b) at least one substance selected from the group consisting of magnesium, calcium, strontium, barium, and admixtures thereof; (c) iron; and (d) phosphorus.

15. A method according to claim 1, wherein the copper-based metal which is grain refined is an alpha-brass or an alpha-beta-brass.

16. A method according to claim 1, wherein the copper-based metal which is grain refined is a bronze.

17. A method according to claim 1, wherein the copper-based metal which is grain refined is a gunmetal.

18. A grain refiner for grain refining a grain refinable copper-based metal, and consisting essentially of each of the following components (a) to (d) in a form suitable to be incorporated in a melt of the grain refinable copper-based metal which is to be grain refined, said components (a) to (d) consisting essentially of:

(a) (at least one substance selected from the group consisting of titanium and) zirconium;

(b) at least one substance selected from the group consisting of lithium, sodium, potassium, beryllium, magnesium, calcium, strontium and barium;

(c) at least one substance selected from the group consisting of scandium, yttrium, hafnium, vanadium, niobium, tantalum, chromium, molybdenum, tungsten, manganese, technetium, rhenium, iron, ruthenium, osmium, cobalt, rhodium, iridium, nickel, palladium, platinum, silver, gold, zinc, cadmium, mercury and the rare earth elements; and (d) at least one substance selected from the group consisting of aluminium, gallium, indium, silicon, germanium, tin, lead, phosphorus, arsenic, antimony, bismuth, sulphur, selenium, and tellurium.

19. A grain refiner according to claim 18, wherein component (a) is zirconium, component (b) is magnesium, component (c) is iron, and component (d) is phosphorus.

20. A grain refiner according to claim 18, wherein component (b) comprises at least one of: magnesium, calcium, strontium and barium.

21. A grain refiner according to claim 20, wherein component (b) comprises magnesium.

22. A grain refiner according to claim 18 21, wherein component (c) comprises at least one of: iron, silver and tungsten.

23. A grain refiner according to claim 22, wherein component (c) comprises iron.

24. A grain refiner according to claim 18; wherein component (d) is present as an antimony-based master alloy containing at least one substance selected from the group consisting of selenium, tellurium an admixtures thereof.

25. A grain refiner according to claim 18, wherein component (d) comprises phosphorus.

26. A grain refiner according to claim 18, wherein component (a) comprises zirconium; component (b) comprises at least one of: magnesium, calcium, strontium and barium; component (c) comprises iron; and component (d) comprises phosphorus.

27. A grain refiner according to claim 18, wherein at least one of the components (a) to (d) is contained in a master alloy selected from the group consisting of aluminum-based master alloys and copper-based master alloys.

28. A grain refiner according to claim 18, wherein each of components (a) to (d) is contained in a separate, distinct master alloy, and component (a) is contained in a copper-based alloy comprising zirconium; component (b) is contained in one or more copper-based alloys comprising at least one substance selected from the group consisting of magnesium, calcium, strontium, barium and admixtures thereof; component (c) is contained in a copper-based alloy comprising iron; and component (d) is contained in a copperbased alloy comprising phosphorus.

29. A grain refiner according to claim 18 in the form of a single master alloy containing components (a) to (d).

30. A grain refiner according to claim 18, in the form of a copper-based master alloy comprising: (a) zirconium; (b) at least one substance selected from the group consisting of magnesium, calcium, strontium, barium, and admixtures thereof; (c) iron; and (d) phosphorus.

* * * * *

UNITED STATES PATENT AND TRADEMARK OFFICE

CERTIFICATE OF CORRECTION

PATENT NO. : 4,786,469

DATED : November 22, 1988

INVENTOR(S) : GERHARD WEBER and WINFRIED REIF

It is certified that error appears in the above-identified patent and that said Letters Patent is hereby corrected as shown below:

Column 2, Line 20, delete "tellirium" and substitute -- tellurium --;

Column 3, Line 20, delete "by" and substitute -- be --;

Column 7, Line 49, delete "by" and substitute -- but --;

Column 8, Line 34, delete "selecium" and substitute -- selenium --;

Column 8, Line 60, delete "copperbased" and substitute -- copper-based --;

Column 9, Lines 21 and 22, delete "(at least one substance selected from the group consisting of titanium and)"

Column 10, Line 3, delete "21."; and

Column 10, Line 34, delete "copperbased" and substitute -- copper-based --.

Signed and Sealed this

First Day of August, 1989

*Attest:*

*Attesting Officer*

DONALD J. QUIGG

*Commissioner of Patents and Trademarks*